US006440626B2

(12) United States Patent
Komatsu et al.

(10) Patent No.: US 6,440,626 B2
(45) Date of Patent: Aug. 27, 2002

(54) IMAGE FORMING METHOD AND IMAGE FORMING APPARATUS

(75) Inventors: Toru Komatsu; Hirotaka Kabashima, both of Hachioji (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/817,575

(22) Filed: Mar. 26, 2001

(30) Foreign Application Priority Data

Mar. 28, 2000 (JP) ..... 2000-088780

(51) Int. Cl.[7] ..... G03G 13/22
(52) U.S. Cl. ..... 430/100; 430/66; 399/252
(58) Field of Search ..... 430/65, 66, 120, 430/100, 97; 399/252

(56) References Cited

U.S. PATENT DOCUMENTS 6,045,962 A * 4/2000 Kushibiki et al. ..... 430/66
6,156,471 A * 12/2000 Kobori et al. ..... 430/120

* cited by examiner

*Primary Examiner*—John Goodrow
(74) *Attorney, Agent, or Firm*—Bierman, Muserlian nad Lucas

(57) ABSTRACT

An image forming method, comprising steps of: forming a toner image on an organic electrophotographic photoreceptor having a siloxane based resin layer as a protective layer with a developer carried on a developing sleeve, wherein a distance Dsd ($\mu$m) between the organic electrophotographic photoreceptor and the developing sleeve and a thickness t ($\mu$m) of the protective layer of the organic electrophotographic photoreceptor satisfy formula (1):

$$35t+400<Dsd \quad (1)$$

12 Claims, 2 Drawing Sheets

IMAGE FORMING METHOD AND IMAGE FORMING APPARATUS

BACKGROUND OF THE INVENTION

The present invention relates to an image forming method as well as to an image forming apparatus, and more specifically to an image forming method as well as an image forming apparatus employed in the field of copiers and printers.

In recent years, widely employed as electrophotographic photoreceptors have been organic electrophotographic photoreceptors (hereinafter referred to as organic photoreceptors or simply photoreceptors) comprising organic photoconductive materials. As compared to other electrophotographic photoreceptors, organic photoreceptors exhibit the following advantages, that is, it is easy to develop materials which respond to various types of exposure light sources, ranging from visible light to infrared radiation; it is possible to select materials which do not result in environmental pollution; production cost is lower; and the like. The only defect is that the mechanical strength is not sufficient and during copying or printing a large number of sheets, the organic photoreceptor surface results in deterioration as well as abrasion.

As one method for improving mechanical abrasive wear properties of said organic photoreceptors, Japanese Patent Publication Open to Public Inspection No. 6-118681 discloses a hardenable silicone resin layer comprising colloidal silica which is used as the surface layer of a photoreceptor. However, the organic photoreceptor, in which said hardenable silicone resin layer comprising colloidal silica is used as the surface layer, exhibits insufficient electrophotographic properties, and during image formation employing many sheets, problems with a decrease in image density or background staining occur.

In order to overcome the drawbacks of said hardenable silicone resin layer comprising colloidal silica, the researchers involved with the present invention proposed to employ a charge transferable hardenable polysiloxane resin layer as the protective layer of an organic photoreceptor. The resultant organic photoreceptor, having said protective layer, exhibits improved abrasive wear resistance as well as improved electrophotographic properties, and during image formation of many sheets, neither decrease in image density nor background staining results.

In recent years, in image forming methods utilizing an electrophotographic system, a digital system image forming method, employing a laser beam image exposure, and the like, has been widely employed instead of the conventional image forming method, employing analogue system image exposure. In laser beam printers, which utilize the electrophotographic system, or copiers, facsimile machines, and the like, employing the digital system, images such as text, graphics, and the like, are formed on the photoreceptor utilizing a binary recording in which a laser beam is exposed or not exposed onto said photoreceptor. In other words, a dot image is formed for each pixel to form an image. In such image exposure utilizing a digital system, the widely employed method for processing images is that an image area such as text, graphics, and the like is exposed and the exposed area is visualized employing reversal development. When the image forming method, utilizing said digital system reversal development, is applied to the organic photoreceptor comprised of said charge transferable polysiloxane hardenable resin layer, images result in granular appearance and problems occur in which the reproduction of text is degraded or in a flat image (in which approximately uniform density dominates a constant area), the image disappears in the lower image portion. As a result, it has been found that the stabilizing effects for image formation of many sheets are not usefully utilized.

SUMMARY OF THE INVENTION

It is an object of the present invention to provide an image forming method and an image forming apparatus which can produce excellent electrophotographic images, employing an organic electrophotographic photoreceptor having a protective layer in which mechanical abrasive wear resistance is sufficiently improved, and more specifically to provide an image forming method and an image forming apparatus which result in excellent reproduction of halftones as well as text, employing an organic electrophotographic photoreceptor having a siloxane based resinous layer as the protective layer.

The inventors of the present invention have conducted various investigations to overcome the aforementioned problems. Discovered, as a result, was the relationship which affects image quality during image formation between the thickness of the protective layer of the organic electrophotographic photoreceptor having a siloxane based resin layer as the protective layer, and development conditions which develop a latent image in said organic electrophotographic photoreceptor, and thus the present invention has been realized.

Namely, it was discovered that the object of the present invention is achieved utilizing any of the embodiments described below.

1. In an image forming method in which a toner image is formed on an organic electrophotographic photoreceptor having a siloxane based resin layer as the protective layer, employing a developer material, an image forming method wherein distance Dsd ($\mu$m) between said organic electrophotographic photoreceptor and the development sleeve, bearing said developer material, is related to the protective layer thickness t($\mu$m) of said organic electrophotographic photoreceptor so as to satisfy to Formula (1):

$$35t+400<Dsd \quad (1)$$

2. In an image forming method in which at least each of the processes of charging, image exposure and development is applied onto the surface of an organic electrophotographic photoreceptor having a siloxane based resin layer as the protective layer, an image forming method wherein said image exposure process is carried out employing a digital image exposure system, the distance Dsd ($\mu$m) between said organic electrophotographic photoreceptor and the development sleeve, bearing a developer material employed in said development process, is related to the protective layer thickness t($\mu$m) of said organic electrophotographic photoreceptor, as well as to the difference $\Delta V$ (V) between the voltage applied to said development sleeve and the electric potential in the exposed area of said organic electrophotographic photoreceptor so as to satisfy to Formula (2):

$$|(35t+400)\times\Delta V|/500<Dsd \quad (2)$$

3. The image forming method described in 1. or 2. above, wherein said siloxane based resin layer has structural units having charge transportability as well as a bridge structure.

4. In an image forming apparatus which forms a toner image on an organic electrophotographic photoreceptor having a siloxane based resin layer as the protective layer, employing a developer material, an image forming apparatus wherein distance (Dsd) between said organic electrophotographic photoreceptor and the development sleeve, bearing said developer material, is related to the protective layer thickness (t) of said organic electrophotographic photoreceptor so as to conform to the aforementioned Formula (1).

5. In an image forming apparatus which possesses at least each of the means of charging, image exposure and development above the surface of an organic electrophotographic photoreceptor having a siloxane based resin layer as the protective layer, an image forming apparatus wherein said image exposure means is comprised of a digital image exposure system, and distance (Dsd) between said organic electrophotographic photoreceptor and the development sleeve, bearing a developer material employed in said development means is related to the protective layer thickness (t) of said organic electrophotographic photoreceptor as well as the difference (ΔV) between the voltage applied to said development sleeve and the electric potential in the exposed area of said organic electrophotographic photoreceptor so as to conform to the aforementioned Formula (2).

6. The image forming apparatus described in 4. or 5. above, wherein said siloxane based resin layer has structural units having charge transportability as well as a bridge structure.

DETAILED DESCRIPTION OF PREFERRED EMBODIMENTS

Figure 1:
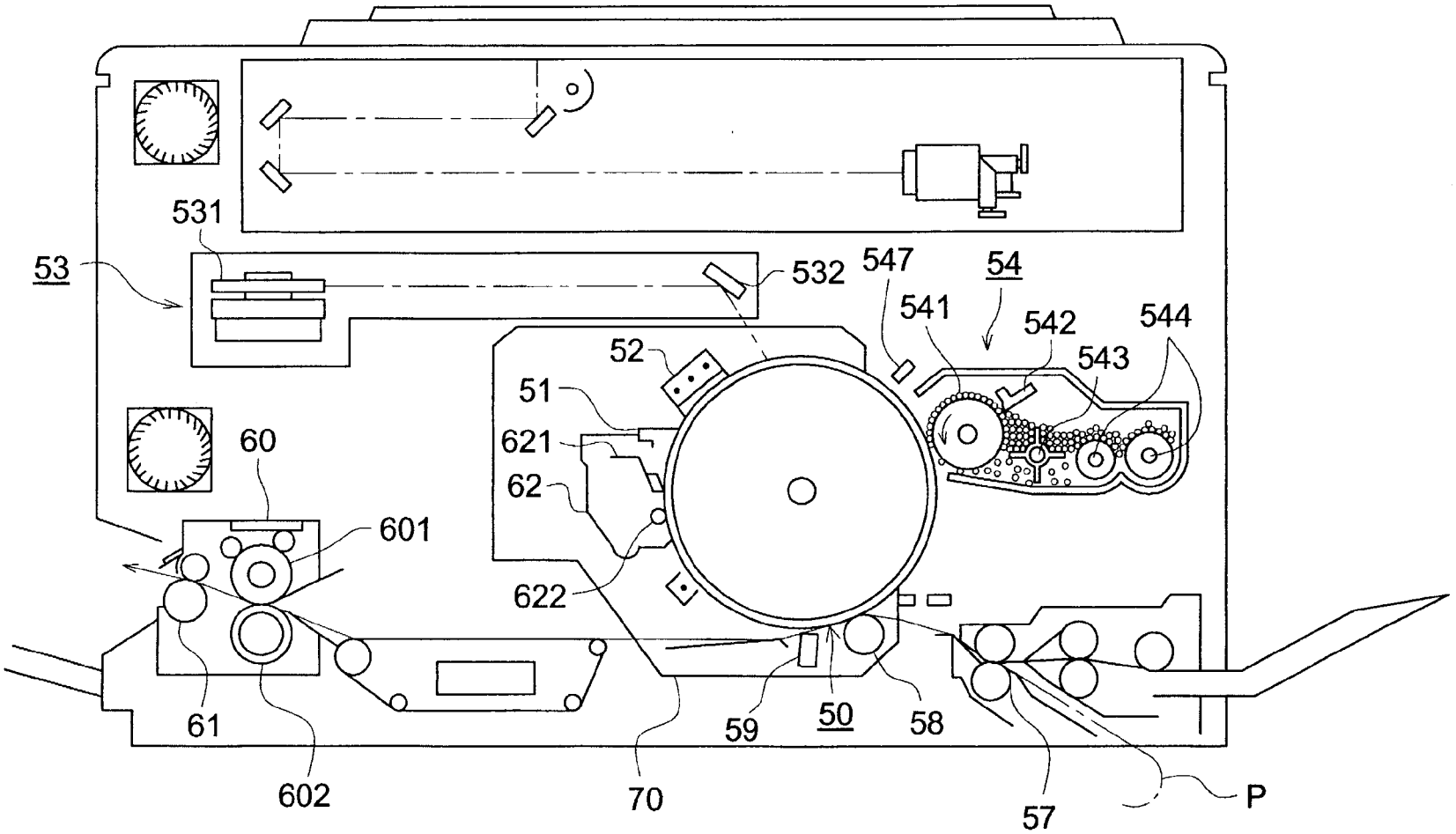
FIG. 1 is a cross-sectional view of an image forming apparatus as an example of the image forming method of the present invention.

The present invention will now be detailed.

Formula (1) which relates to a first image forming method of the present invention shows that while visualizing a latent image on an organic electrophotographic photoreceptor having a siloxane based resin layer as the protective layer employing a development process, excellent electrographic images are obtained when distance (Dsd) between said photoreceptor and the development sleeve bearing a developer material is related to protective layer thickness (t) so as to conform to the aforementioned Formula (1).

Namely, it was discovered that when said distance (Dsd) was less than the width, in terms of used length unit, represented by the left term of the aforementioned Formula (1) which includes layer thickness (t) of said siloxane based resin, the definition of text images was degraded and an image disappearing phenomena in the lower image portion of a flat image tended to occur.

Heretofore, in order to improve the definition of text images and to minimize the image disappearing phenomena in the lower image portion of the flat image, it has been supposed that an increase in developability is useful and it has been commonly understood that the shorter the distance between the photoreceptor and the development sleeve is within the level in which the conveyed amount of the developer material on the development sleeve, the more useful. Therefore, the unexpected discovery of the present invention was quite surprising in which the definition of text images was effectively improved, as well as the image disappearing phenomena in the lower image portion of the flat image were also effectively minimized by allowing said distance (Dsd) to be greater in terms of length unit than the left terms of the aforementioned Formula (1), which included protective layer thickness (t) of the siloxane based resin.

Formula (2), which relates to the second image forming method of the present invention, optimizes Formula (1) in such a manner that with respect to the image forming method, in which digital latent images are formed on an organic electrophotographic photoreceptor having a siloxane based resin layer as the protective layer, are formed and said digital latent images are visualized employing a reversal development process, a specific parameter for the development of digital images, e.g. difference (ΔV) between the voltage applied to the development sleeve and the electric potential of the exposed area of said organic electrophotographic photoreceptor, is introduced to said Formula (1).

It was discovered that for visualization of the digital images, when said distance (Dsd) between the photoreceptor and the development sleeve, bearing the developer material, was greater in terms of length unit than the right terms of the aforementioned Formula (2) which included said protective layer thickness (t) of the siloxane based resin layer and said difference (ΔV) between the voltage applied to said development sleeve and the electric potential of the exposed area of said organic electrophotographic photoreceptor, excellent images were obtained in which the definition of text images were improved and the image disappearing phenomena in the lower image portion of the flat image was minimized.

Next, the embodiment of the image forming apparatus according to the present invention will be specifically described with reference to the attached drawings, and specific examples, in which image formation is carried out employing the embodied image forming apparatus, are cited with descriptions. Further, it is clarified that images, which exhibit excellent definition of text images as well as excellent reproducibility of flat images, are obtained employing an image forming method in which the organic electrophotographic photoreceptor, having the siloxane based resin layer as the protective layer, is used.

FIG. 1 is a cross-sectional view of an image forming apparatus as an example of the image forming method of the present invention.

In FIG. 1, reference numeral 50 is a photoreceptor drum (also a photoreceptor) which is an image bearing body. Said photoreceptor is prepared by applying the resinous layer of the present invention onto its surface, is then grounded, and rotates clockwise. Reference numeral 52 is a scorotron charging unit, and results in uniform charging on the circumferential surface of photoreceptor drum 50, employing corona discharge. Prior to charging employing said charging unit 52, in order to eliminate the hysterisis of the photoreceptor due to the previous image formation, the circumferential surface of said photoreceptor may be subjected to charge elimination employing precharging exposure section 51 comprised of light emitting diodes, and the like.

After uniformly charging said photoreceptor, exposure is carried out based on image signals, employing image exposure unit 53. The image exposure unit in FIG. 1 employs laser diodes as the exposure light source (not shown). Scanning is carried out employing light which passes through rotational polygonal mirror 531 and fθ lens, and is deflected by reflection mirror 532. Thus electrostatic latent images are formed.

The electric potential of the exposed area of the photoreceptor of the present invention, as described herein, means one which is measured in the vicinity of the upper part of the development position, when the photoreceptor surface is uniformly charged employing image exposure unit 53 (in laser exposure, exposure is continuously carried out). The measurement is carried out by providing an electric potential sensor 547 at the upper part of the development position, as shown in FIG. 1.

Said electrostatic latent images are subsequently developed by development unit 54. Around photoreceptor drum 50, development unit 54, in which the developer material, comprised of a tone and a carrier, is provided, and development is carried out employing development sleeve 541 which is provided with internal magnets, and rotates while bearing the developer material. The interior of said developer unit 54 is fabricated with developer material stirring member 544, developer material conveying member 543, conveying amount regulating member 542, and the like. Thus, the developer material is stirred, conveyed and supplied to said development sleeve. The supply amount is controlled by said conveying amount regulating member 542. The conveyed amount of said developer material varies depending on the linear speed of an applied organic electrophotographic photoreceptor as well as its specific gravity, but is commonly in the range of 20 to 200 mg/cm$^2$.

Said developer material is comprised of, for example, a carrier which is prepared by coating insulation resins onto the surface of the aforementioned ferrite as the core, and a toner which is prepared by externally adding silica, titanium oxide, and the like, to colored particles comprised of the aforementioned styrene-acryl based resins as the primary material, colorants such as carbon black, and the like, charge control agents, and low molecular weight polyolefin of the present invention. Said developer material is regulated so as to have a thickness of 100 to 600 $\mu$m on development sleeve 541, employing said conveying amount regulating member, and then conveyed to the development zone, where development is then carried out. At that time, development is carried out while direct current bias voltage, if desired, alternative current bias voltage is applied to the space between photoreceptor drum 50 and development sleeve 541. Further, the developer material is subjected to development in a contact or non-contact state with the photoreceptor.

Recording paper P is supplied to the transfer zone by the rotation of paper feeding roller 57, when timing for transfer is properly adjusted.

In the transfer zone, transfer roller (in the transfer unit) 58 is brought into pressure contact with the circumferential surface of photoreceptor drum 50, while synchronizing with transfer timing, and image transfer is carried out onto fed recording paper P which is brought into contact with both said photoreceptor drum 50 and said transfer roller 58.

Subsequently, the resultant recording paper P is subjected to charge elimination, employing separation brush 59 (in the separation unit) 59 which is brought into pressure contact at almost the same time as when said transfer roller is brought into the same state, is separated from the circumferential surface of photoreceptor drum 50, and conveyed to fixing unit 60. Then, after the toner is fused under heat and pressure, provided by heated roller 601 as well as pressure contact roller 602, the resulting recording paper P is ejected to the exterior of the apparatus via paper ejection roller 61. Further, after passage of recording paper P, said transfer roller 58, as well as said separation brush, withdraws from the circumferential surface of photoreceptor drum 50, and is prepared for the formation of subsequent toner images.

On the other hand, photoreceptor drum 50, from which recording paper P has been separated, is subjected to removal of any residual toner and cleaning through pressure contact with blade 621 of cleaning unit 62, and then subjected to charge elimination employing precharge exposure section 51, as well as subjected to charging employing charging unit 52. Said photoreceptor drum 50 then enters the subsequent image forming process.

Incidentally, reference numeral 70 is a detachable processing cartridge, which is integrally comprised of a photoreceptor, a charging unit, a transfer unit, a separation unit, and a cleaning unit.

Figure 2:
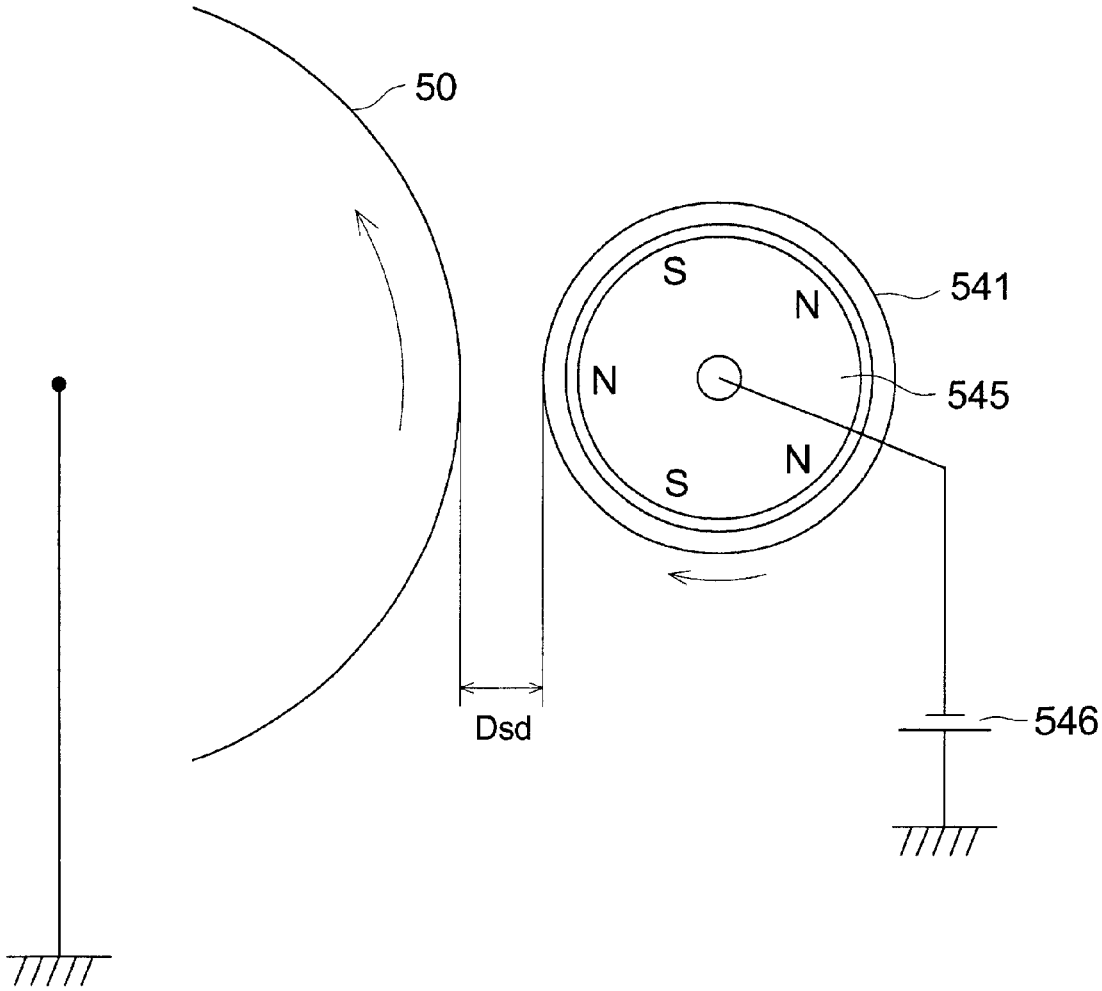
FIG. 2 is an enlarged view of a portion of photoreceptor drum 50 and development sleeve 51.

FIG. 2 is an enlarged view of a portion of photoreceptor drum 50 and development sleeve 541, shown also in said FIG. 1.

As shown in FIG. 2, distance (Dsd) between the organic electrophotographic photoreceptor and the development sleeve, bearing said developer material, is defined as the shortest distance (width) which is formed between said photoreceptor drum 50 and the development sleeve. Distance (Dsd) between said organic electrophotographic photoreceptor and the development sleeve bearing said developer material may be simply described as Dsd.

Magnetic member 545 having a plurality of magnetic poles N, S . . . are provided within the inner circumference of said development sleeve 541. It is possible to rotate the development sleeve so it moves in the same direction as, or in the opposite direction to, the photoreceptor drum in the development region. However, in the present invention, the movement direction is preferably the same direction, that is, both preferably move mutually in the opposite direction with each other.

In the development region, where development sleeve 541 faces photoreceptor drum 50, development is carried out by conveying the developer material to the development region facing photoreceptor drum 50 with the use of the rotation of development sleeve 541, while maintaining said developer material on said development sleeve 541, employing the magnetic force of said magnet member 545.

Further, during development, direct current power source 546 is connected to development sleeve 541, and voltage is applied to development sleeve 541 employing said power force 546. Thus in the development region, development bias voltage of direct current voltage is applied to the space between development sleeve 541 and photoreceptor drum 50. As described above, toner in the developer material conveyed to the development region by development sleeve 541 is supplied onto a latent image on photoreceptor drum 50, and thus development is carried out.

In the present invention, image forming conditions for the reversal development preferably employed in the present invention are preferably a charge potential of 450 to 950 V in terms of an absolute value, a direct current applied to the development sleeve of 350 to 800 V, also in terms of an absolute value, distance (Dsd) between the organic electrophotographic photoreceptor and development sleeve bearing said developer material is between 350 and 800 $\mu$m, and the linear velocity ratio of the photoreceptor to the development sleeve is preferably between 1:1 and 1:3.5. When said Dsd exceeds 800 $\mu$m, the development electric field becomes too weak and tends to degrade developability.

The organic electrophotographic photoreceptors, having the siloxane based resin layer of the present invention as the protective layer, will be described next. In the present invention, the organic electrophotographic photoreceptors as described herein mean those which are constituted employing organic compounds which exhibit either a charge generating function, or a charge transport function, which is essential for constituting electrophotographic photoreceptors, and include all organic electrophotographic photoreceptors known in the art such as photoreceptors comprised of either organic charge generating materials or organic charge transports materials known in the art, photoreceptors comprised of polymer complexes exhibiting both a charge generating function and a charge transport function, and the like.

The siloxane based resin layer of the present invention preferably possesses structural units exhibiting charge transport performance and preferably also possesses a bridge structure.

Said siloxane based resin layer is commonly obtained so that the hydrolyzed product of a hardenable organic silicon compound undergoes dehydration condensation. Representatively, said siloxane based resin layer is formed by applying onto a support a coating composition in which organic silicon compounds represented by General Formula (1) described below are employed as raw materials, and subsequently dried. These raw materials form condensation products (oligomers) in a solvent through hydrolysis in a hydrophilic solvent followed by the condensation reaction. By applying a coating composition comprised of these onto a support and subsequently drying the resultant coating, it is possible to form said siloxane based resin layer which forms a three-dimensional net structure.

$$(R)_n\text{—Si—}(X)_{4-n} \qquad \text{General Formula (1)}$$

wherein Si represents a silicon atom, R represents an organic group having a structure in which a carbon atom directly bonds to said silicon atom, and n represents an integer of 0 to 3.

In the organic silicon compounds represented by General Formula (1), listed as organic groups represented by R, which have structures in which a carbon atom directly bonds to a silicon atom, are alkyl groups such as methyl, ethyl, propyl, butyl, and the like; aryl groups such as phenyl, tolyl, naphthyl, biphenyl, and the like; epoxy containing groups such as γ-glycidoxypropyl, β-(3,4-epoxycyclohexyl) ethyl, and the like; acryloyl or methacryloyl containing groups such as γ-acryloxypropyl, γ-methacryloxypropyl; hydroxy containing groups such as γ-hydroxypropyl, 2,3-dihydroxypropyloxypropyl, and the like; vinyl containing groups such as vinyl, propenyl, and the like; mercapto containing groups such as γ-mercaptopropyl, and the like; amino containing groups such as γ-aminopropyl, N-β-(aminoethyl)-γ-aminopropyl, and the like; halogen containing groups such as γ-chloropropyl, 1,1,1-trifluoropropyl, nonafluorohexyl, perfluoroctylethyl, and the like; and others such as, a nitro-, cyano-substituted alkyl group. Further, listed as hydrolyzable groups represented by X are alkoxy groups such as methoxy, ethoxy, and the like, halogen atoms, and acyloxy groups. Specifically preferred are alkoxy groups having 6 or less carbon atoms.

Further, when in specific compounds represented by General Formula (1), n is at least 2, a plurality of X may be the same or different. In the same manner, when n is no more than 2, a plurality of X may be the same or different. Still further, when at least two compounds represented by General Formula (1) are employed, R and X may be the same or different in each compound.

Further, when a siloxane based resin layer is formed employing a coating composition which is prepared by using, in combination, organic silicon compounds represented by said General Formula (1) in which n is 1 and 2, it is possible to form a protective layer which exhibits high mechanical wear resistance as well as excellent cleaning properties.

Still further, when a siloxane based resin layer is formed employing a coating composition which is prepared by using, in combination, organic silicon compounds represented by General Formulas (2) and (3) both of which correspond to General Formula (1) in which n is 1 and 2, it is possible to form a protective layer which exhibits excellent physical surface cleaning properties.

$$R_1Si(X)_3 \qquad \text{General Formula (2)}$$

$$R_1R_2Si(X)_2 \qquad \text{General Formula (3)}$$

wherein $R_1$ and $R_2$ each represent an alkyl group having from 1 to 10 carbon atoms, an aryl group, a vinyl group, an amino group, a γ-glycidoxypropyl group, a γ-methacryloxypropyl group, and $C_nF_{2n+1}C_2H_4$–. n represents an integer of 1 to 6, and X represents a hydroxyl group or a hydrolyzing group.

Said siloxane based resin layer, which is obtained employing organic silicon compounds represented by General Formulas (2) and (3) or hydrolyzed products thereof, or condensation products obtained from said hydrolyzed products, exhibits the desired elasticity as well as the desired rigidity, and further exhibits small surface free energy. As a result, it is possible to form a protective layer which minimizes filming of toner as well as paper dust and exhibits the desired physical surface properties.

Listed as specific examples of organic silicon compounds represented by said General Formula (2) are those described below:

Namely, said compounds include trichlorosilane, methyltrichlorosilane, vinyltrichlorosilane, ethyltrichlorosilane, allyltrichlorosilane, n-propyltrichlorosilane, n-butyltrichlorosilane, chloromethyltriethoxysilane, methyltrimethoxysilane, mercaptomethyltrimethoxysilane, trimethoxyvinylsilane, ethyltrimethoxysilane, 3,3,4,4,5,5,6,6,6-nonafluorohexyltrichlorosilane, phenyltrichlorosilane, 3,3,3-trifluoropropyltrimethoxysilane, 3-chloropropyltrimethoxysilane, triethoxysilane, 3-mercaptopropyltrimethoxysilane, 3-aminopropyltrimethoxysilane, 2-aminoethylaminomethyltrimethoxysilane, benzyltrichlorosilane, methyltriacetoxysilane, chloromethyltriethoxysilane, ethyltriacetoxysilane, phenyltrimethoxysilane, 3-allylthiopropyltrimethoxysilane, 3-glycidoxypropyltrimethoxysilane, 3-bromopropyltriethoxysilane, 3-allylaminopropyltrimethoxysilane, propyltriethoxysilane, hexyltrimethoxysilane, 3-aminopropyltriethoxysilane, 3-methacryloxypropyltrimethoxysilane, bis (ethylmethylketoxim) methoxymethylsilane, pentyltriethoxysilane, octyltriethoxysilane, dococyltriethoxysilane, and the like.

Listed as specific examples of organic silicon compounds represented by said General Formula (3) are those described below:

Said compounds include dimethyldichlorosilane, dimethoxymethylsilane, dimethoxydimethylsilane, methyl-3,3,3-trifluoropropyldichlorosilane, diethoxysilane, diethoxymethylsilane, dimethoxymethyl-3,3,3-trifluoropropylsilane, 3-chloropropyldimethoxymethylsilane, chloromethyldiethoxysilane, diethoxydimethylsilane, dimethoxy-3-mercaptopropylmethylsilane, 3,3,4,4,5,5,6,6,6-nonafluorohexylmethyldichlorosilane, methylphenyldichlorosilane, diacetoxymethylvinylsilane, diethoxymethoylvinylsilane, 3-methacryloxypropylmethyldichlorosilane, 3-aminopropyldiethoxymethylsilane, 3-(2-aminoethylaminopropyl)dimetoxymethylsilane, t-butylphenyldichlorosilane, 3-methacryloxypropyldimethoxymethylsilane, 3-(3-cyanopropylthiopropyl)dimethoxymethylsilane, 3-(2-acetoxyethylthiopropyl)dimethoxymethylsilane, dimethoxymethyl-2-piperidinoethylsilane, dibutoxydimethylsilane, 3-dimethylaminopropyldiethoxymethylsilane, diethoxymethylphenylsilane, diethoxy-3-glycidoxypropylmethylsilane, 3-(3-acetoxypropylthio) propyldimethoxymethylsilane, dimethoxymethyl-3-piperidinopropylsilane, dietoxymethyloctadecylsilane, and the like.

The most preferred siloxane based resin layer of the present invention is one in which said siloxane based resin layer itself exhibits desired charge transportability as well as small surface energy, and adhesion to the layer adjacent to said siloxane based resin layer, as well as its brittleness is improved.

Said siloxane based resin layer possesses structural units exhibiting charge transportability, as well as a bridge structure. Said siloxane based resin layer possessing the structural units exhibiting charge transportability, as well as the bridge structure, is specifically formed employing condensation reaction of the charge transportable compounds represented by General Formula (4) described below with said organic silicon compounds or condensation products thereof. Said siloxane based resin layer is capable of forming a protective layer which exhibits a small increase in residual potential as well as small surface free energy and minimizes filming of toner as well as paper dust, and exhibits physical layer properties in which adhesion to the adjacent layer as well as brittleness is improved.

$$B—(R_1—ZH)_m \qquad \text{General Formula (4)}$$

wherein B represents a univalent or multivalent group comprising transportable structural units, $R_1$ represents a single bond or divalent alkylene group, Z represents an oxygen atom, a sulfur atom, or NH, and m represents an integer of 1 to 4.

"B" in General Formula (4) is a univalent or higher valent group comprising a charge transportable compound structure. "B comprises a charge transportable compound structure", as described herein, means that the compound structure, from which the ($R_1$-ZH) group in said General Formula (4) is removed, possesses charge transportability, or BH compounds obtained by substituting the ($R_1$-ZH) group with a hydrogen atom possesses charge transportability.

Incidentally, said charge transportable compounds are those which show the quality of exhibiting mobility of electrons or positive holes. Further, those defined as compounds may be in which electric current, due to charge transport, is detected employing methods known in the art, such as the Time-Of-Flight Method, and the like.

The siloxane based resin layer of the present invention, which possesses structural units exhibiting charge transportability in said siloxane based resin layer, is formed employing a condensation reaction of said organic silicon compounds with charge transport compounds. In the siloxane based resin layer of the present invention, charge transportable compounds, which are capable of reacting with said organic silicon compounds may be employed instead of the charge transportable compounds represented by said General Formula (4).

Inorganic metal oxide particles having a diameter of 5 to 500 nm are preferably incorporated into said siloxane based resin layer. Namely, said siloxane based resin layer is preferably a composite resin layer exhibiting charge transportability, which is obtained by applying onto a support a composition comprised of organic silicon compounds having a hydroxyl group or a hydrolyzing group, or condensation products of said organic silicon compounds, charge transportable compounds having a hydroxyl group, and inorganic metal oxide particles having a diameter of 5 to 500 nm., and subsequently dried.

Said metal oxide particles having a diameter of 5 to 500 nm are commonly synthesized employing a liquid phase method. Listed as examples of metal atoms are Si, Ti, Al, Cr, Zr, Sn, Fe, Mg, Mn, Ni, Cu, and the like. These metal oxide particles are obtained in the form of colloidal particles.

Further, said metal oxide particles preferably possess on their surface a chemical group which is capable of reacting with said organic silicon compounds. Cited as said chemical group having such reactivity are, for example, a hydroxyl group, an amino group, and the like. By employing metal oxide particles having such reactivity, the protective layer of the present invention forms a composite siloxane based resin layer comprised of said siloxane based resin and said metal oxide particles in which the particle surface is subjected to a chemical bond. As a result, the strength as well as elasticity of the resultant resin layer is improved. When said siloxane based resin layer is employed as the protective layer of a photoreceptor, a layer is formed which exhibits high wear resistance to counter sliding during cleaning and the like, as well as excellent electrophotographic properties.

The composition ratio of the total amount (H) of said organic silicon compounds having a hydroxyl group or a hydrolyzing group, and condensation products prepared from the organic silicon compounds having a hydrolyzing group, to amount (I) of the compounds represented by said General Formula (4) is preferably between 100:3 and 50:100 in terms of the weight ratio, and is more preferably between 100 10 and 50:100.

Further, the added amount of said metal oxide particles (J) is preferably between 1 and 30 parts by weight with respect to 100 parts by weight of the total of said total amount (H) plus the amount of the compound (I).

When said components, having the total amount (H), are employed within said range, the photoreceptor surface layer of the present invention exhibits high hardness as well as the desired elasticity. On the other hand, when said compound, having the amount (I), is employed within said range, excellent electrophotographic properties such as sensitivity, residual potential, and the like are exhibited and said photoreceptor surface layer exhibits high hardness.

Further, it is preferable that said siloxane based resin layer be dried at relatively high temperature of at least 80° C., and further, after drying, it is reheated at 30 to 100° C. for several hours.

During the formation of said siloxane based resin layer, in order to promote condensation reaction, condensation catalysts described below are preferable.

Employed as specific condensation catalysts may be conventional catalysts known in the art, such as acids, metal oxides, metal salts, metal chelate compounds, alkylaminosilane compounds, and the like, which are employed in silicone hard coat materials. However, preferred are phosphoric acid, acetic acid and others such as titanium chelates, aluminum chelates and tin organic acid salts (such as stannous octoate, dibutyl tin acetate, dibutyl tin laurate, dibutyl tin mercaptide, dibutyl tin thiocarboxylate, dibutyl tin maleate, and the like).

Examples of preferred compounds represented by said General Formula (4) are illustrated below. However, the present invention is not limited to said illustrated compounds below.
(B-1)
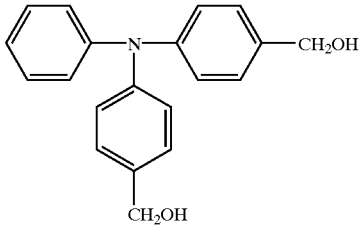
(B-2)
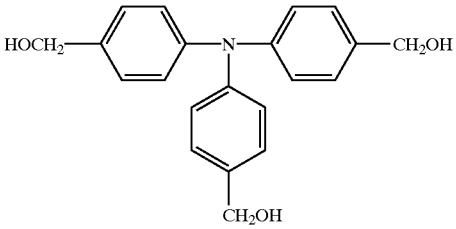
(B-3)
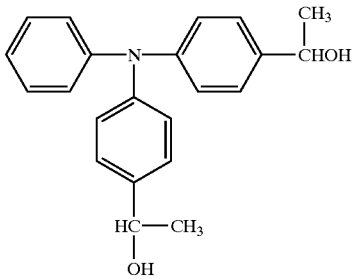
(B-4)
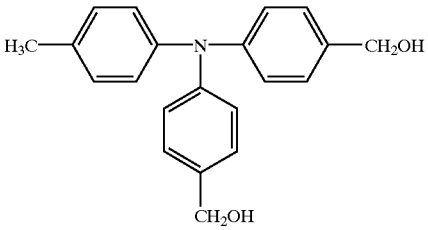
(B-5)
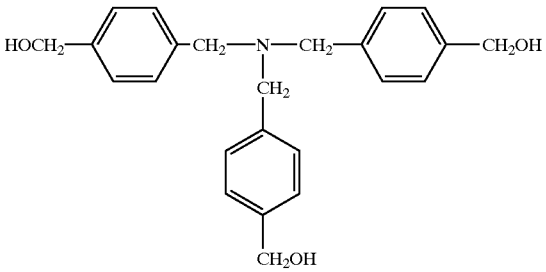
(B-6)
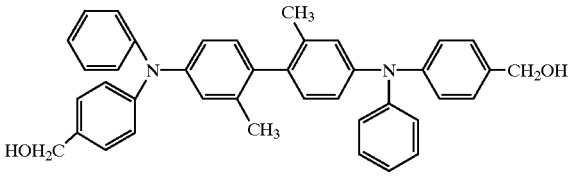
-continued
(B-7)
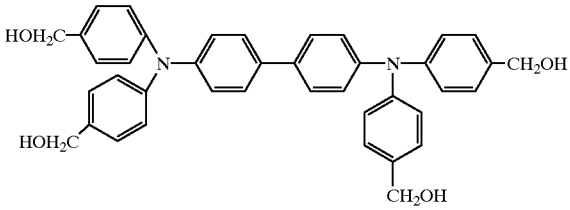
(B-8)
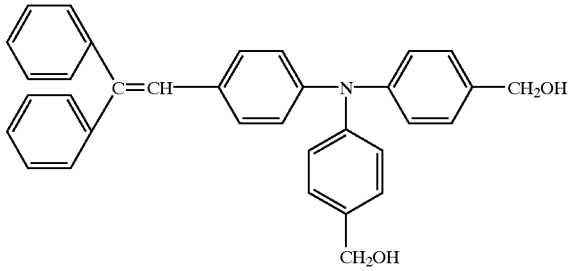
(B-9)
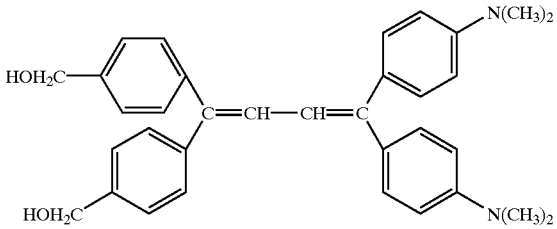
(B-10)
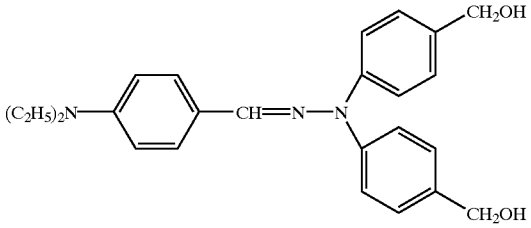
(B-11)
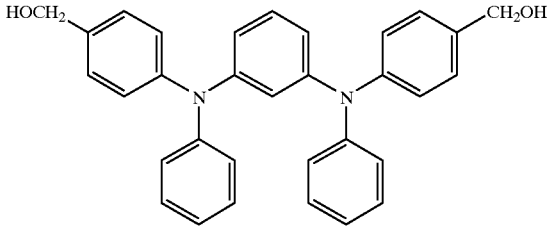
(B-12)
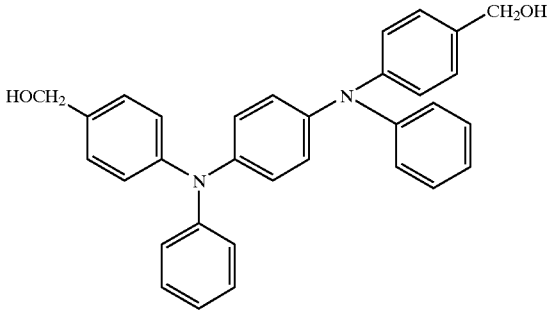

-continued (B-13)

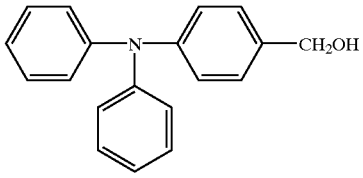

(B-14)

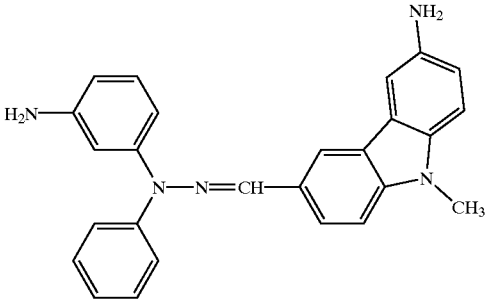

(B-15)

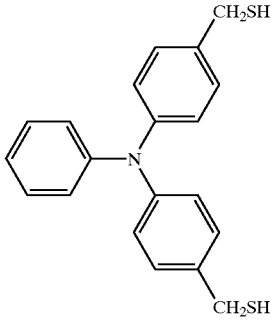

Antioxidants are preferably incorporated into said siloxane based resin layer. Said antioxidants, as described herein, mean materials, as representative ones, which minimize or retard the action of oxygen under conditions of light, heat, discharging, and the like, with respect to auto-oxidizing materials which exist in the electrophotographic photoreceptor or the surface thereof. Specifically, a group of such compounds described below is listed.

1-1

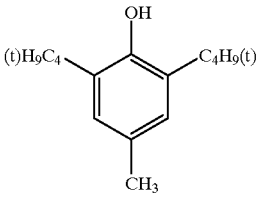

1-2

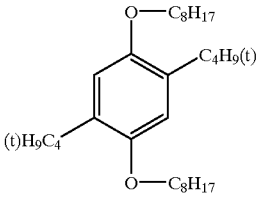

-continued 1-3

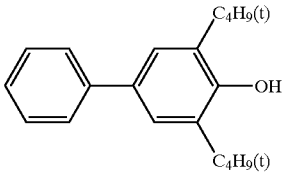

1-4

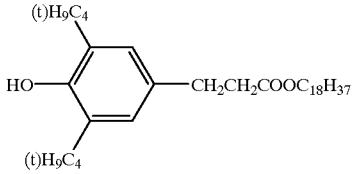

1-5

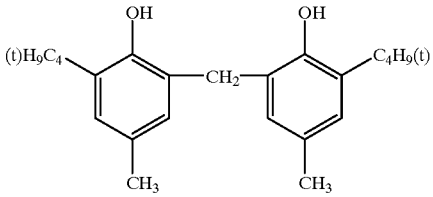

1-6

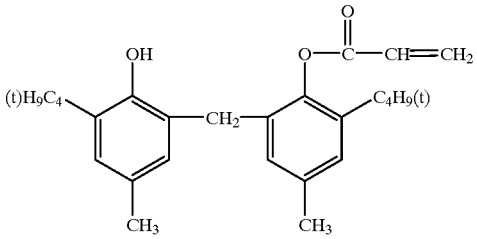

1-7

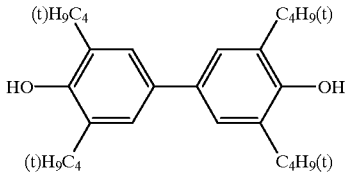

1-8

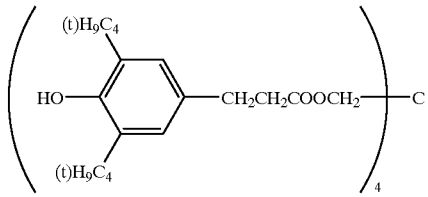

1-9

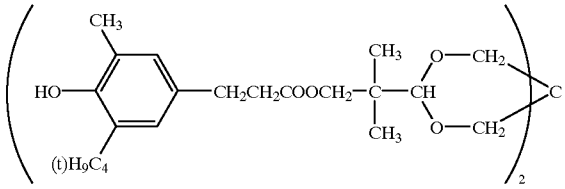

-continued 1-10

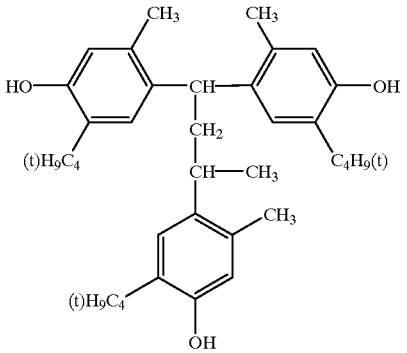

2-1

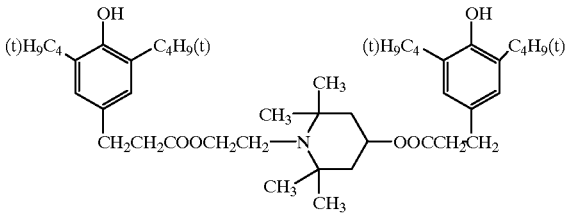

2-2

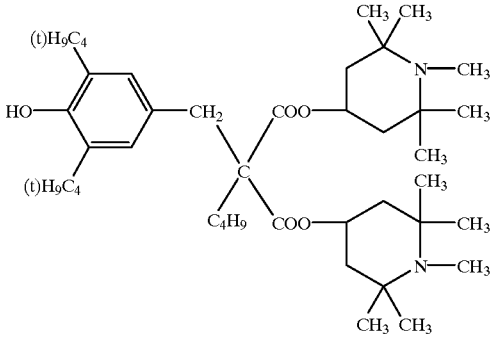

2-3

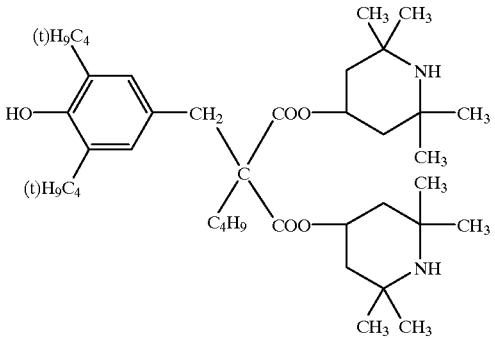

Next, the layer configuration of the photoreceptor of the present invention, other than said protective layer, will now be described. The layer configuration of the organic electrophotographic photoreceptor of the present invention is not particularly limited, but it is preferably constituted so that a protective layer is applied onto a photosensitive layer such as a charge generating layer, a charge transport layer, a charge generating and charge transport layer (a layer which exhibits both charge generating and charge transport functions), and the like.

The configuration of the photoreceptor employed in the present invention will now be described.

Electrically Conductive Support

Employed as electrically conductive supports employed for the photoreceptor of the present invention may be either a sheet-like support or a cylindrical support, but in order to design a compact image forming apparatus, the cylindrical electrically conductive support is more preferable.

The cylindrical electrically conductive support, as described in the present invention, means a cylindrical support which is capable of forming continuous images by repeated rotation. The electrically conductive support, having a circularity in the range of no more than 0.1 mm as well as a fluctuation of no more than 0.1 mm, is preferable. When said circularity as well as said fluctuation exceeds said range, it becomes difficult to form excellent images.

Employed as electrically conductive materials may be metal drums comprised of aluminum, nickel, and the like, plastic drums evaporated with aluminum, tin oxide, indium oxide, and the like, or paper-plastic drums coated with electrically conductive materials. Said electrically conductive supports preferably exhibits a specific resistance of $10^3$ Ωcm or less at normal temperature.

The electrically conductive support employed in the present invention may have an anodized aluminum film on its surface, which is subjected to sealing. An anodized aluminum treatment is generally carried out in an acid bath such as, for example, chromic acid, sulfuric acid, oxalic acid, phosphoric acid, boric acid, sulfamic acid, and the like. Of these, anodic oxidation in sulfuric acid provides the most preferable results. The anodic oxidation in sulfuric acid is preferably carried out under conditions of a sulfuric acid concentration of 100 to 200 g/liter, an aluminum ion concentration of 1 to 10 g/liter, a solution temperature of about 20° C., and an applied voltage of 20 V. However, said conditions are not limited to these cited ones. Further, the average thickness of the resultant anodic oxidation film is generally no more than 20 μm, and is most preferably no more than 10 μm.

Interlayer

In the present invention, it is possible to provide an interlayer having a barrier function between the electrically conductive support and the photosensitive layer.

In the present invention, in order to improve adhesion between the electrically conductive support and said photosensitive layer, or to minimize charge injection from said support, it is possible to provide an interlayer (including a sublayer) between said support and said photosensitive layer. Listed as materials of said support are polyamide resins, vinyl chloride resins, vinyl acetate resins, and copolymer resins comprising at least two repeating units of these resins. Of these subbing resins, polyamide resins are preferable as the resins which are capable of minimizing an increase in residual potential during repeated use. Further, the thickness of the interlayer comprised of these resins is preferably between 0.01 and 2 μm.

Further, listed as interlayers, which are most preferably employed, are those comprised of hardenable metal resins which are subjected to thermal hardening employing organic metal compounds such as silane coupling agents, titanium coupling agents, and the like. The thickness of the interlayer comprised of said hardenable metal resins is preferably between 0.1 and 2 μm.

Photosensitive Layer

The photosensitive layer configuration of the photoreceptor of the present invention may be one comprised of a single layer structure on said interlayer, which exhibits a charge generating function as well as a charge transport function. However, a more preferable configuration is that the photosensitive layer is comprised of a charge generating layer (CGL) and a charge transport layer (CTL). By employing said configuration in which the functions are separated, it is possible to control the increase in residual potential during repeated use at a low level, and to readily control the other electrophotographic properties to desired values. A negatively charged photoreceptor is preferably composed in such a manner that applied onto the interlayer is the charge generating layer (CGL), onto which the charge transport layer is applied. On the other hand, a positively charge photoreceptor is composed so that the order of the layers employed in the negatively charged photoreceptor is reversed. The most preferable photosensitive layer configuration is the negatively charged photoreceptor configuration having said separate function structure.

The photosensitive layer configuration of a function separated and negatively charged photoreceptor will now be described.

Charge Generating Layer

The charge generating layer comprises charge generating materials (CGM). As for other materials, if desired, binder resins and other additives may also be incorporated.

Employed as charge generating materials may be those commonly known in the art. For example, employed may be phthalocyanine pigments, azo pigments, perylene pigments, azulenium pigments, and the like. Of these, CGMs, which are capable of minimizing any increase in residual potential, during repeated use, are those which comprise a three-dimensional electrical potential structure capable of forming a stable agglomerated structure among a plurality of molecules. Specifically listed are CGMs of phthalocyanine pigments and perylene pigments having a specific crystal structure. For instance, titanyl phthalocyanine having a maximum peak at 27.2° of Bragg angle 2θ with respect to a Cu—Kα line, benzimidazole perylene having a maximum peak at 12.4° of said Bragg 2θ, and the like, result in minimum degradation under repeated use and can minimize the increase in residual potential.

When binders in the charge generating layer are employed as the dispersion media of CGM, employed as binders may be any of the resins known in the art. Listed as the most preferable resins are formal resins, butyral resins, silicone resins, silicone modified butyral resins, phenoxy resins, and the like. The ratio of binder resins to charge generating materials is preferably between 20 and 600 weight parts per 100 weight parts of the binder resins. By employing these resins, it is possible to minimize the increase in residual potential under repeated use. The thickness of the charge generating layer is preferably between 0.01 and 2 μm.

Charge Transport Layer

The charge transport layer comprises charge transport materials (CTM) as well as binders which disperse CTM and form a film. As for other materials, if desired, also incorporated may be additives such as antioxidants and the like.

Employed as charge transfer materials (CTM) may be any of the several known in the art. For example, it is possible to employ triphenylamine derivatives, hydrazone compounds, styryl compounds, benzidine compounds, butadiene compounds, and the like. These charge transport materials are commonly dissolved in appropriate binder resins and are then subjected to film formation. Of these, CTMs, which are capable of minimizing the increase in residual potential under repeated use, are those which exhibit properties such as high mobility as well as an ionization potential difference of no more than 0.5 eV, and preferably no more than 0.25 eV from a combined CGM.

The ionization potential of CGM and CTM may be measured employing a Surface Analyzer AC-1 (manufactured by Riken Keiki Co.).

Cited as resins employed in the charge transport layer (CTL) are, for example, polystyrene, acrylic resins, methacrylic resins, vinyl chloride resins, vinyl acetate resins, polyvinyl butyral resins, epoxy resins, polyurethane resins, phenol resins, polyester resins, alkyd resins, polycarbonate resins, silicone resins, melamine resins, and copolymers comprising at least two repeating units of these resins, and other than these insulating resins, also high molecular organic semiconductors, such as poly-N-vinylcarbazole.

The most preferable as CTL binders are polycarbonate resins. Polycarbonate resins are most preferred because the dispersibility of CTM as well as electrophotographic properties is improved. The ratio of binder resins to charge transport materials is preferably between 10 and 200 weight parts per 100 weight parts of the binder resins. Further, the thickness of the charge transport layer is preferably between 10 and 40 μm.

Protective Layer

By providing said siloxane based resin layer as the protective layer of the photoreceptor, it is possible to obtain the photoreceptor having the most preferable layer configuration of the present invention.

Listed as solvents or dispersion media which are employed to form layers such as interlayers, photosensitive layers, protective layers, and the like, are n-butylamine, diethylamine, ethylenediamine, isopropanolamine, triethanolamine, triethylenediamine, N,N-dimethylformamide, acetone, methyl ethyl ketone, methyl isopropyl ketone, cyclohexanone, benzene, toluene, xylene, chloroform, dichloromethane, 1,2-dicholorethane, 1,2-dichloropropane, 1,1,2-trichloroethane, 1,1,1-trichloroethane, trichloroethylene, tetrachloroethane, tetrahydrofuran, dioxysolan, dioxane, methanol, ethanol, butanol, isopropanol, ethyl acetate, butyl acetate, dimethyl sulfoxide, methyl cellosolve, and the like. However, the present invention is not limited to these examples, and also preferably employed are dichloromethane, 1,2-dicholorethane, methyl ethyl ketone, and the like. Further, these solvents may be employed individually or in combination as a solvent mixture of two or more types.

Employed as coating methods to produce electrophotographic organic photoreceptors of the present invention are such as dip coating, spray coating, circular amount regulating type coating, and the like. When an upper layer is applied onto the photosensitive layer, preferably employed coating methods are such as spray coating or circular amount—regulating type coating (including a circular slide hopper type as its representative example) and the like so that the dissolution of the lower layer is minimized and uniform coating is achieved. Incidentally, the protective layer of the present invention is most preferably applied employing said circular amount-regulating type coating method. Said circular amount-regulating type coating is detailed in, for example, Japanese Patent Publication Open to Public Inspection No. 58-189061.

The organic electrophotographic photoreceptor of the present invention is applicable to common electrophotographic apparatuses such as electrophotographic copiers, laser printers, LED printers, and liquid crystal shutter type printers, and the like. Further, it is also applicable to apparatuses such as display, recording, small volume printing, plate making, and facsimile machines to which electrophotographic techniques are applied.

EXAMPLES

The present invention will now be detailed with reference to examples, but the embodiments of the present invention are not limited to these examples. Incidentally, "parts" in the following description means "parts by weight", unless otherwise specified.

Example 1

Preparation of Photoreceptor 1

Photoreceptor 1

| <Sublayer> | |
|---|---|
| Titanium chelate compound (TC-750, manufactured by Matsumoto Seiyaku) | 30 g |
| Silane coupling agent (KMB-503, manufactured by Shin-Etsu Kagaku) | 17 g |
| 2-Propanol | 150 ml |

The coating composition described above was applied onto a ϕ100 mm cylindrical electrically conductive support so as to obtain a dried layer thickness of 0.5 μm.

| <Charge Generating Layer> | |
|---|---|
| Y type titanyl phthalocyanine (having a maximum peak angle of 27.3 at 2θ of X-ray diffraction employing Cu-Kα characteristic X-ray) | 60 g |
| Silicone modified butyral resin (X-40-1211M, manufactured by Shin-Etsu Kagaku) | 700 g |
| 2-Butanone | 2000 ml |

were blended and dispersed for 10 hours, employing a sand mill to prepare a charge generating layer coating composition. The resultant coating composition was applied onto said sublayer, employing a dip coating method, and a charge generating layer, having a dried layer thickness of 0.2 μm, was formed.

| <Charge Transport Layer> | |
|---|---|
| Charge transport material (N-(4-methylphenyl)-N-{4-(diphenylstyryl)phenyl}-p-toluidine | 225 g |
| Polycarbonate (having a viscosity average molecular weight of 30,000) | 300 g |
| Antioxidant (Exemplified Compound 1-3) | 6 g |
| Dichloromethane | 2000 ml |

were blended and dissolved to prepare a charge transport layer coating composition. The resultant coating composition was applied onto said charge generating layer employing a dip coating method, and a charge transport layer having a dried layer thickness of 20 μm was formed.

| <Protective Layer> | |
|---|---|
| Methyltrimethoxysilane | 182 g |
| Exemplified Compound (B-1) | 50 g |
| Antioxidant (Exemplified Compound 2-1) | 1 g |
| 1-Butanol | 225 g |
| Colloidal silica (30% methanol solution) | 100 g |
| 2% Acetic acid | 106 g |
| Aluminum trisacetylacetonato | 1 g |

The silane compound, 1-butanol, and 2 percent acetic acid were blended, and the resulting mixture was stirred at 40° C. for 16 hours. Thereafter, exemplified compound (B-1), antioxidant, and aluminum torisacetylacetonato were added and the resulting mixture was stirred at room temperature for one hour to prepare a sublayer coating composition. The resultant coating composition was applied onto said charge transport layer employing a circular amount-regulating type coating apparatus to form a resinous layer having a dried layer thickness of 1 μm. The resultant resinous layer was thermally hardened at 110° C. for one hour. Thus Photoreceptor 1 was prepared in which a protective layer was formed which was comprised of a siloxane based resin layer possessing structural units exhibiting charge transfer performance and having a bridge structure.

Photoreceptors 2 through 4

Photoreceptors 2, 3, and 4 were prepared in the same manner as Photoreceptor 1, except that the dried layer thickness of the protective layer of Photoreceptor 1 was varied to 2, 3, and 4 μm.

Preparation of Developer Material

Developer Material 1

After melt kneading a mixture consisting of 100 parts of styrene acrylic resin comprised of a weight ratio of styrene : butyl acrylate butyl methacrylate =75:20:5, 10 parts of carbon black, and 4 parts of low molecular weight polypropylene (having a number average molecular weight of 3500), fine pulverization was carried out employing a mechanical pulverizing machine, and subsequently, classification was carried out. Thus colored particles having a volume average particle diameter of 6.5 μm were obtained.

As external additives, added were 0.4 part of hydrophobic silica particles (R805, manufactured by Nihon Aerosil Co.), having an average particle diameter of 12 nm and 0.6 part of titania particles (T805, manufactured by Nihon Aerosil Co.) to 100 parts of said obtained colored particles. The resultant blend was mixed at normal temperature at a circumferential speed of 40 m/second for 10 minutes, employing a Henschel mixer to obtain a negatively chargeable toner. The adhesion ratio of the resultant toner was 45 percent.

A ferrite carrier having a volume average particle diameter of 60 μm, which had been coated with a silicone resin, was blended with said toner, and a developer material was prepared, which had a toner concentration of 5 percent.

Image Evaluation

As shown in Table 1, types of photoreceptors and the distance between said photoreceptor and the development sleeve bearing the developer material were combined, and the uncopied image in the lower image portion as well as the reproduction of text was evaluated. Each combination of said photoreceptors and developer materials was fitted to a Konica 7075 digital copier (comprising processes employing corona charging, laser exposure, reversal development, electrostatic transfer, claw separation, blade cleaning) manufactured by Konica Corp., which basically carried out image forming processes shown in FIG. 1, and the evaluation was carried out by adjusting said Dsd. Other image evaluation conditions are described below.

Image Evaluation Conditions

Image evaluation condition employing Konica 7075 is set the following condition.

Charging Conditions

Charging unit: scorotron charging unit, the initial charge potential was −750 V.

Exposure Conditions

Exposure amount was set which resulted in −50 V of electric potential in the exposed area.

Development Conditions

DC bias: −550 V

Dsd (distance between the photoreceptor and the development sleeve): conditions shown in Table 1

Regulation of the developer material layer: toner height regulation plate

Conveying amount of the developer material: 100 mg/cm$^2$

Development sleeve diameter: 50 mm

Transfer Conditions

Transfer electrodes: corona charging system

Cleaning Conditions The cleaning section was brought into contact with a urethane cleaning blade having a hardness of 70°, an impact resilience of 34 percent, a thickness of 2 mm, and a free length of 9 mm at a contact angle 10±0.5° in the counter direction and a linear pressure of 20 g/cm, employing a load system.

Image evaluation was carried out as follows: an original image consisting of equal quarters of a text image, a halftone image comprised of the patch image described below, a solid white image, and a solid black image was used, and said original image was copied onto A4 size sheets at normal temperature and normal humidity (24° C. and 60 percent relative humidity).

Evaluation Criteria of Copied Images

Uncopied Image in the Lower Image Portion of the Flat Image

A 20×30 mm patch image (having a uniform density over the whole area) was used in the part of said original image and the length of a uncopied image in the lower image portion of the copied patch image was recorded.

A: the length of a uncopied image in the lower image portion was less than 0.5 mm B: the length of a uncopied image in the lower image portion was between at least 0.5 mm and less than 1 mm C: the length of a uncopied image in the lower image portion was at least 1 mm.

Text Reproduction

A text image comprising 5.5 point Chinese characters in said original image was employed, and the fifth generation copied image was evaluated. Herein a first generation copied image is a copied image from an original, a second generation copied image is a copied image from the first generation copied image, etc. Thus the 5th generation copied image is a copied image from the fourth generation copied image.

A: 5.5 point characters were readily identified

B: 5.5 point characters were identified with difficulty

C: 5.5 point characters were not identified.

TABLE 1

| Photo-recep-tor No. | HC Layer Thick-ness (μm) | 35t + 400 (μm) | Dsd (μm) | Uncopied image of Flat Image | Text Repro-duction | Remarks |
|---|---|---|---|---|---|---|
| 1 | 1 | 435 | 400 | C | B | Not |
| 2 | 2 | 470 | 400 | C | C | Not |
| 3 | 3 | 505 | 400 | C | C | Not |
| 4 | 4 | 540 | 400 | C | C | Not |
| 1 | 1 | 435 | 450 | A | A | Inv. |
| 2 | 2 | 470 | 450 | C | B | Not |
| 3 | 3 | 505 | 450 | C | C | Not |
| 4 | 4 | 540 | 450 | C | C | Not |
| 1 | 1 | 435 | 500 | A | A | Inv. |
| 2 | 2 | 470 | 500 | A | A | Inv. |
| 3 | 3 | 505 | 500 | B | B | Not |
| 4 | 4 | 540 | 500 | C | C | Not |
| 1 | 1 | 435 | 550 | A | A | Inv. |
| 2 | 2 | 470 | 550 | A | A | Inv. |
| 3 | 3 | 505 | 550 | A | A | Inv. |
| 4 | 4 | 540 | 550 | A | A | Inv. |
| 1 | 1 | 435 | 600 | A | A | Inv. |
| 2 | 2 | 470 | 600 | A | A | Inv. |
| 3 | 3 | 505 | 600 | A | A | Inv. |
| 4 | 4 | 540 | 600 | A | A | Inv. |

Not: not in the present invention
Inv.: in the present invention

As can clearly be seen from Table 1, when Dsd of the aforementioned copier was adjusted to be greater than (35t+400) (μm) in the formula showing the relationship with layer thickness "t" of the siloxane based resin layer of the present invention, the flat image as well as the text reproduction was excellent, while in comparative examples in which when Dsd was smaller than said (35t+400), the flat image as well as the text reproduction was insufficient.

Example 2

In addition to the variation of photoreceptors as well as the Dsd distance, development bias voltage was varied from −400 to −650 V, and photoreceptors, Dsd, and differences (ΔV) between the voltage applied to the development sleeve and the electric potential in the exposed area of said photoreceptor were combined as shown in Table 2. Then, evaluation was carried out in the same manner as for Example 1. Table 2 shows the evaluation results.

TABLE 2

| Photo-receptor No. | HC Layer Thickness (μm) | ΔV | 35t + 400 (μm) | (35t + 400) × ΔV/500 | Dsd (μm) | Uncopied image of Flat Image | Text Re-produc-tion | Remarks |
|---|---|---|---|---|---|---|---|---|
| 1 | 1 | 400 V | 435 | 360 | 440 | A | A | Inv. |
| 2 | 2 | 400 V | 470 | 380 | 480 | A | A | Inv. |
| 3 | 3 | 400 V | 505 | 400 | 510 | A | A | Inv. |
| 4 | 4 | 400 V | 540 | 420 | 400 | C | B | Not |
| 1 | 1 | 450 V | 435 | 392 | 440 | A | A | Inv. |
| 2 | 2 | 450 V | 470 | 423 | 400 | C | B | Inv. |
| 3 | 3 | 450 V | 505 | 455 | 400 | C | C | Inv. |
| 4 | 4 | 450 V | 540 | 486 | 400 | C | C | Inv. |
| 1 | 1 | 500 V | 435 | 435 | 400 | C | C | Inv. |
| 2 | 2 | 500 V | 470 | 470 | 400 | C | C | Inv. |

TABLE 2-continued

| Photo-receptor No. | HC Layer Thickness (μm) | ΔV | 35t + 400 (μm) | (35t + 400) × ΔV/500 | Dsd (μm) | Uncopied image of Flat Image | Text Re-produc-tion | Remarks |
|---|---|---|---|---|---|---|---|---|
| 3 | 3 | 500 V | 505 | 505 | 400 | C | C | Inv. |
| 4 | 4 | 500 V | 540 | 540 | 400 | C | C | Inv. |
| 1 | 1 | 400 V | 435 | 360 | 500 | A | A | Inv. |
| 2 | 2 | 400 V | 470 | 380 | 500 | A | A | Inv. |
| 3 | 3 | 400 V | 505 | 400 | 510 | A | A | Inv. |
| 4 | 4 | 400 V | 540 | 420 | 550 | A | A | Inv. |
| 1 | 1 | 450 V | 435 | 392 | 500 | A | A | Inv. |
| 2 | 2 | 450 V | 470 | 423 | 500 | A | A | Inv. |
| 3 | 3 | 450 V | 505 | 455 | 550 | A | A | Inv. |
| 4 | 4 | 450 V | 540 | 486 | 550 | A | A | Inv. |
| 1 | 1 | 500 V | 435 | 435 | 500 | A | A | Inv. |
| 2 | 2 | 500 V | 470 | 470 | 500 | A | A | Inv. |
| 3 | 3 | 500 V | 505 | 505 | 500 | C | B | Not |
| 4 | 4 | 500 V | 540 | 540 | 500 | C | C | Not |
| 1 | 1 | 550 V | 435 | 479 | 500 | A | A | Not |
| 3 | 3 | 550 V | 505 | 556 | 500 | C | C | Not |
| 4 | 4 | 550 V | 540 | 594 | 500 | C | C | Not |
| 1 | 1 | 500 V | 435 | 435 | 600 | A | A | Not |
| 2 | 2 | 500 V | 470 | 470 | 600 | A | A | Inv. |
| 3 | 3 | 500 V | 505 | 505 | 600 | A | A | Inv. |
| 4 | 4 | 500 V | 540 | 540 | 600 | A | A | Inv. |
| 1 | 1 | 550 V | 435 | 479 | 600 | A | A | Inv. |
| 2 | 2 | 550 V | 470 | 517 | 600 | A | A | Inv. |
| 3 | 3 | 550 V | 505 | 556 | 600 | A | A | Inv. |
| 4 | 4 | 550 V | 540 | 594 | 600 | A | A | Inv. |
| 1 | 1 | 600 V | 435 | 522 | 600 | A | A | Inv. |
| 2 | 2 | 600 V | 470 | 564 | 600 | A | A | Inv. |

Inv.: in the present invention
Not: not in the present invention

As can clearly be seen from Table 2, when distance Dsd is greater than $|(35t+400)\times\Delta V|/500$ which showed the relationship between layer thickness "t" of the siloxane based resin layer of the present invention and said difference ΔV in the electric potential of the exposed area, the flat image as well as the text reproduction was excellent.

As can clearly be seen from the aforementioned examples, when said Dsd, which is an image forming condition employing the photoreceptor comprising the siloxane based resin layer of the present invention as the protective layer, is greater than the left term of the aforementioned Formulas (1) or (2), which includes layer thickness "t" of said protective layer, it is possible to obtain electrophotographic images which exhibit excellent flat images as well as excellent text reproduction.

What is claimed is:

1. An image forming method, comprising steps of:

forming a toner image on an organic electrophotographic photoreceptor having a siloxane based resin layer as a protective layer, wherein a distance Dsd (μm) between the organic electrophotographic photoreceptor and the developing sleeve and a thickness t (μm) of the protective layer of the organic electrophotographic photoreceptor satisfy formula (1):

$$35t+400<Dsd \quad (1); \text{ and}$$

wherein Dsd is between 350 and 800 μm.

2. The image forming method of claim 1, wherein the siloxane based resin layer has a structural unit having charge transportability and a bridge structure.

3. The image forming method of claim 1, wherein the toner image is formed by a reversal development.

4. An image forming method, comprising steps of:

charging an organic electrophotographic photoreceptor having a siloxane based resin layer as a protective layer;

exposing digital image on the charged photoreceptor by a digital image exposing method so as to form a latent image; and developing the latent image with a developer carried on a developing sleeve so as to form a toner image;

wherein a distance Dsd (μm) between the organic electrophotographic photoreceptor and the developing sleeve, a thickness t (μm) of the protective layer of the organic electrophotographic photoreceptor and a difference ΔV (V) between a voltage (V) applied onto the developing sleeve and an electric potential (V) of an exposed portion of the organic electrophotographic photoreceptor satisfy formula (2):

$$|(35t+400)\times\Delta V|/500<Dsd \quad (2); \text{ and}$$

wherein Dsd is between 350 and 800 μm.

5. The image forming method of claim 4, wherein the siloxane based resin layer has a structural unit having charge transportability and a bridge structure.

6. The image forming method of claim 4, wherein the toner image is formed by a reversal development.

7. An image forming apparatus, comprising an organic electrophotographic photoreceptor having a siloxane based resin layer as a protective layer;

a charging device to charge the organic electrophotographic photoreceptor;

an exposing device to expose an image on the charged organic electrophotographic photoreceptor so as to form a latent image; and a developing device to develop the latent image so as to form a toner image, wherein a distance Dsd ($\mu$m) between the organic electrophotographic photoreceptor and the developing sleeve and a thickness t ($\mu$m) of the protective layer of the organic electrophotographic photoreceptor satisfy formula (1):

$$35t+400<Dsd \quad (1); \text{ and}$$

wherein Dsd is between 350 and 800 $\mu$m.

8. The image forming apparatus of claim 7, wherein the siloxane based resin layer has a structural unit having charge transportability and a bridge structure.

9. The image forming apparatus of claim 7, wherein the toner image is formed by a reversal development.

10. An image forming apparatus, comprising an organic electrophotographic photoreceptor having a siloxane based resin layer as a protective layer;

a charging device to charge the organic electrophotographic photoreceptor;

a digital image exposing device to expose an image on the charged organic electrophotographic photoreceptor so as to form a latent image; and a developing device to develop the latent image so as to form a toner image, wherein a distance Dsd ($\mu$m) between the organic electrophotographic photoreceptor and the developing sleeve, a thickness t ($\mu$m) of the protective layer of the organic electrophotographic photoreceptor and a difference $\Delta V$ (V) between a voltage (V) applied onto the developing sleeve and an electric potential (V) of an exposed portion of the organic electrophotographic photoreceptor satisfy formula (2):

$$|(35t+400)\times\Delta V|/500<Dsd \quad (2); \text{ and}$$

wherein Dsd is between 350 and 800 $\mu$m.

11. The image forming apparatus of claim 10, wherein the siloxane based resin layer has a structural unit having charge transportability and a bridge structure.

12. The image forming apparatus of claim 10, wherein the toner image is formed by a reversal development.

* * * * *